United States Patent [19]

Mueller

[11] 4,427,258

[45] Jan. 24, 1984

[54] ELECTRICAL CONNECTOR

[75] Inventor: Arthur L. Mueller, Camp Hill, Pa.

[73] Assignee: AMP Incorporated, Harrisburg, Pa.

[21] Appl. No.: 321,000

[22] Filed: Nov. 13, 1981

[51] Int. Cl.[3] ..... H01R 4/36

[52] U.S. Cl. ..... 339/272 R; 339/113 R

[58] Field of Search ..... 339/272 R, 272 A, 272 VC, 339/113 R

[56] References Cited

U.S. PATENT DOCUMENTS

| | | | |
|---|---|---|---|
| 2,907,978 | 10/1959 | Bergan | 339/272 R |
| 2,920,305 | 1/1960 | Gibson et al. | 339/272 R |
| 3,195,099 | 7/1965 | Sloop | 339/113 R |
| 3,683,414 | 8/1972 | De Angelo | 339/272 VC |
| 3,915,545 | 10/1975 | Saito | 339/272 VC |
| 4,103,986 | 1/1978 | Izraeli | 339/272 VC |
| 4,213,669 | 7/1980 | Wittes et al. | 339/272 VC |

FOREIGN PATENT DOCUMENTS

| | | | |
|---|---|---|---|
| 888909 | 9/1943 | France | 339/272 VC |

*Primary Examiner*—Eugene F. Desmond
*Assistant Examiner*—David L. Pirlot
*Attorney, Agent, or Firm*—Allan B. Osborne

[57] ABSTRACT

The present invention relates to an electrical connector of the type wherein the wire is removably terminated by being compressed between a wire-receiving surface and a set screw or the like. More particularly, the connector includes a wire-receiving surface and a second member having nonlinear, resilient sidewalls which tend to straighten out as the screw is turned down against the wire. The energy stored in the sidewalls maintain pressure on the wire.

1 Claim, 8 Drawing Figures

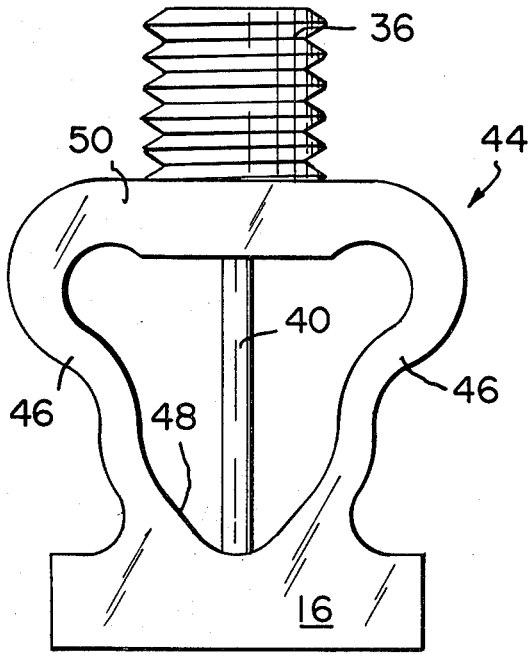
FIG. 5
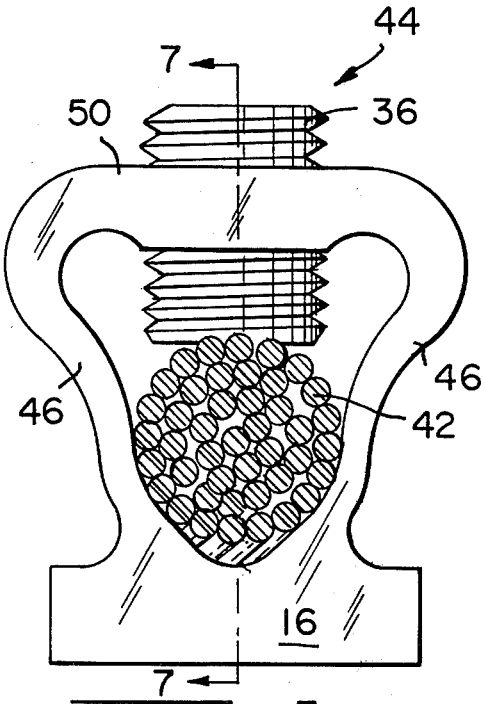
FIG. 6
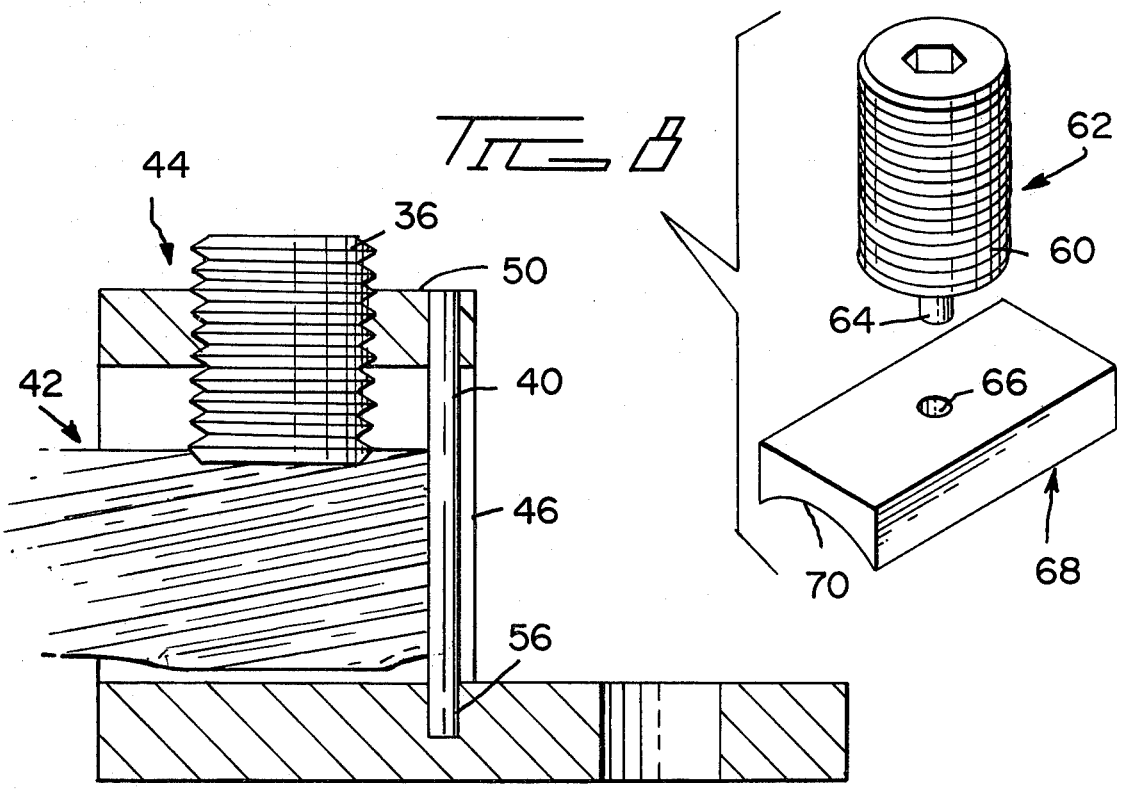
FIG. 8
FIG. 7

ELECTRICAL CONNECTOR

BACKGROUND OF THE INVENTION

1. The Field Of The Invention

The invention disclosed herein relates to electrical connectors of the set-screw type adapted for detachably terminating any one of a plurality of multi-strand wire having different circular mil areas.

2. The Prior Art

The present invention is a novel improvement and a significant advancement in the art over at least the following:

| Pat. No. | Patentee |
|---|---|
| 2,907,978 | Bergan |
| 2,920,305 | Gibson et al |

The aforementioned prior art patents disclose electrical connectors having a frame member into which a wire is inserted, and a set-screw threadedly mounted in the top wall of the member. Upon turning the screw down, the free end engages the wire and compresses it against the lower frame wall to make the mechanical and electrical connection.

SUMMARY OF THE INVENTION

The invention described herein is an electrical connector having resiliently deformable means thereon to insure that a continuation pressure is being exerted against the wire terminated therein. The connector includes one member having a surface on which the wire is laid and a second member having resiliently deformable, non-linear sidewalls and a top wall extending between and joining the sidewalls. The second member is attached to the first member with the wire receiving surface therebetween to form a frame-like structure. A set screw or the like is threadedly mounted in the top wall for being turned down against a wire lying on the surface below. As the tightening increases, the resilient sidewalls tend to straighten out and the frame height increases. The energy required to deform the sidewalls becomes stored therein so that a continuous pressure is exerted against the wire notwithstanding a reduction in the cross-sectional area of the wire due to thermal or other conditions.

BRIEF DESCRIPTION OF THE DRAWINGS

FIG. 5 is an end view of the connector of FIG. 4;

FIG. 6 is the end view of FIG. 5 showing a wire compressed within the connector and the sidewalls deformed with the deformation energy available to maintain pressure on the wire;

FIG. 7 is a cross-sectional view of the electrical connector of FIG. 4 taken along the line 7—7 in FIG. 6; and FIG. 8 shows a modified anvil for compressing the wire in the electrical connectors of FIGS. 1 and 4.

DESCRIPTION OF THE INVENTION

Figure 1:
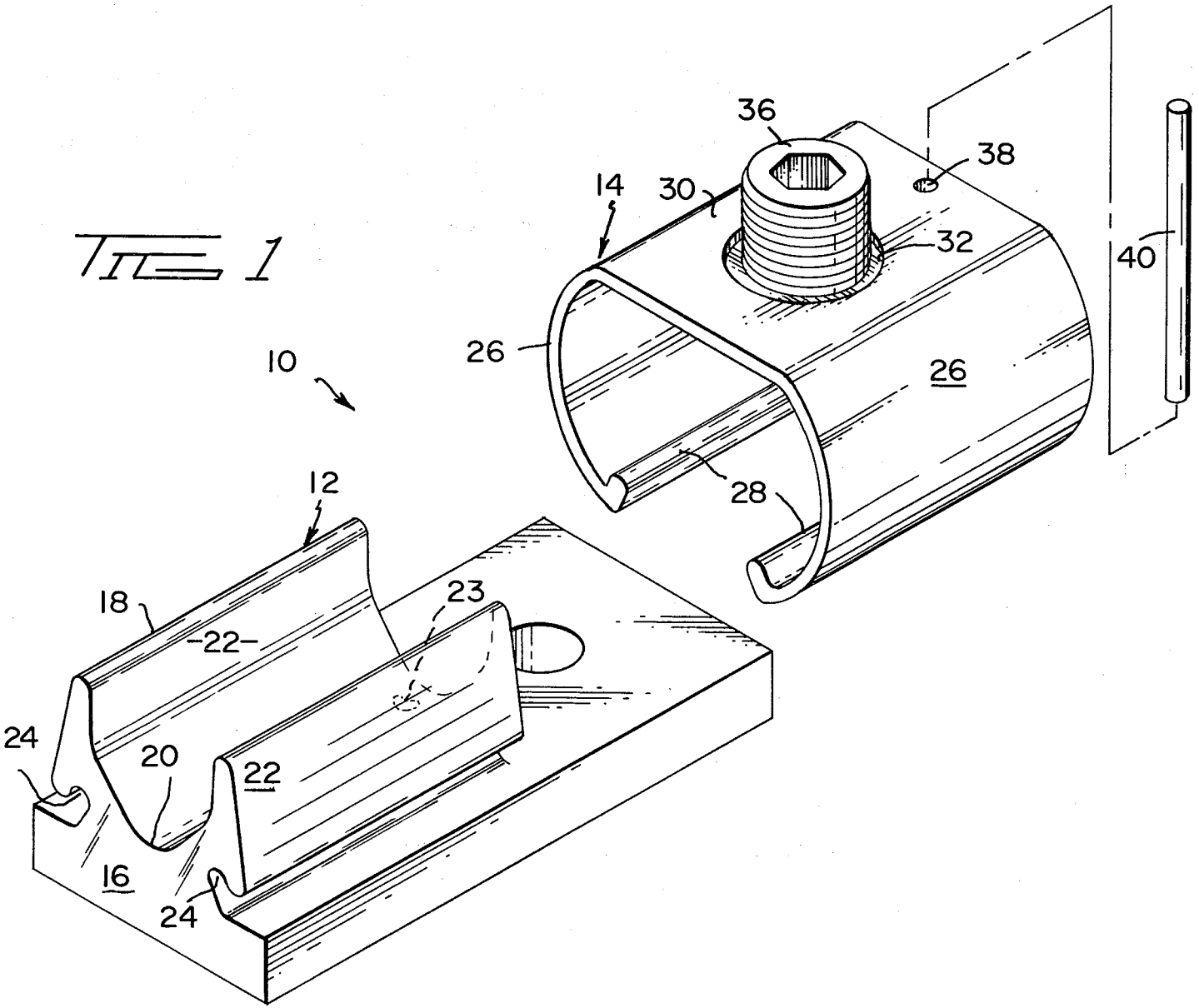
FIG. 1 is a perspective view of the several components of the disassembled electrical connector constructed in accordance with one embodiment of the present invention.
Figure 2:
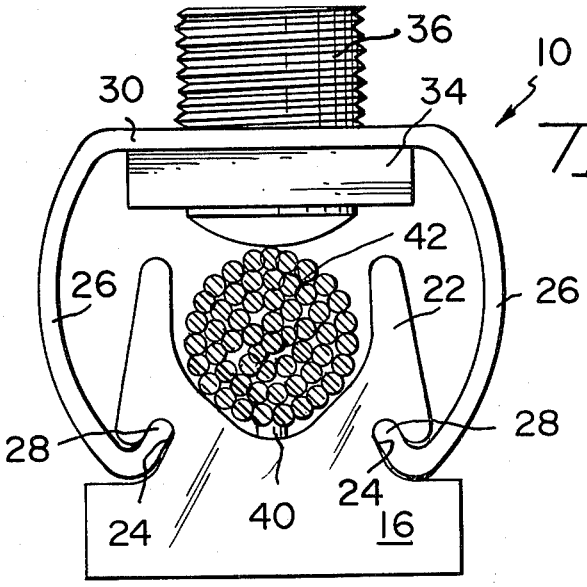
FIG. 2 is an end view of the electrical connector of FIG. 1, now assembled and with a wire therein.
Figure 3:
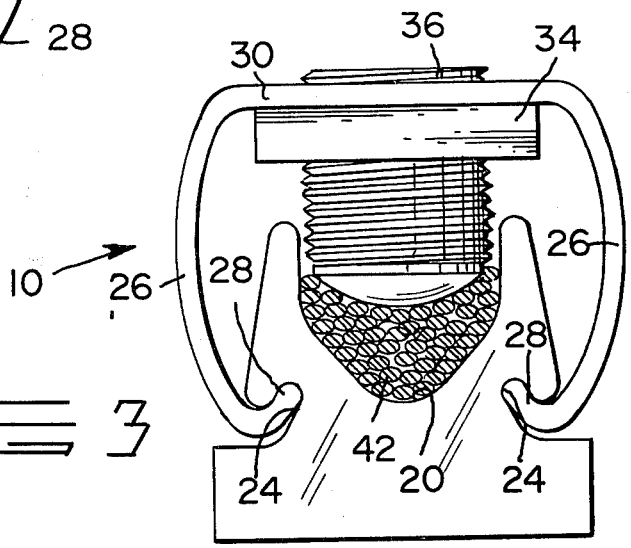
FIG. 3 is the same end view as in FIG. 2 showing the wire compressed and the resilient sidewalls deformed with the deformation energy available to maintain pressure on the wire.
Figure 4:
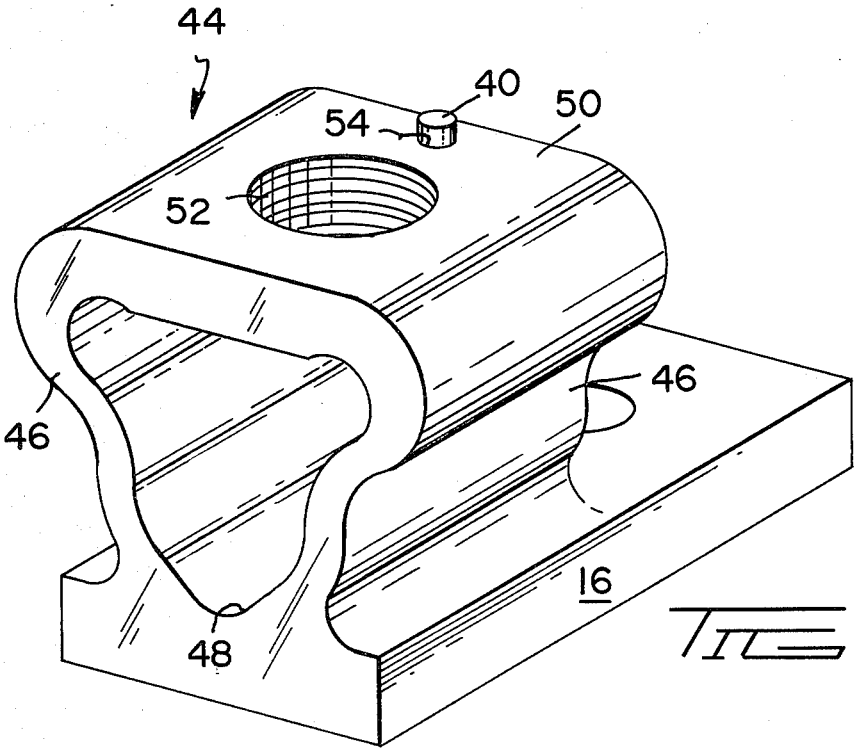
FIG. 4 is a perspective view of an electrical connector constructed in accordance with another embodiment of the present invention.

The electrical connector 10, shown in FIGS. 1, 2, and 3, includes unit 12 and second member 14. With specific reference to FIG. 1, unit 12 includes a base 16 and first member 18. As will be apparent, base 16 is not necessary to the invention. First member 18 is generally channel-shaped with a wire-receiving surface 20 joining sides 22. An aperture 23 may be provided at one end of surface 20. A longitudinal, obliquely upwardly extending notch 24 is located in the outside surface of each side 22. First member 18 is preferably made from aluminum 6101-T6.

Second member 14 has non-linear sidewalls 26; in the illustrated embodiment they have a concavo-convex shape as viewed from an end. Further, and most important, they are resiliently deformable. The lower free edges are turned obliquely upwardly to form hooks 28. Top wall 30 extends between and joins the two sidewalls at the upper edges; i.e., opposite hooks 28. Bore 32 extends through top wall 30 and through plate 34 (FIG. 2) which is secured to the underside of the top wall. The bore through the plate is threaded to receive biasing means 36; i.e., a set screw or the like. Plate 34 may be omitted if the top wall is thick enough for the forces involved. Hole 38 extends through top wall 30 adjacent one end. Pin 40 passes freely through hole 38 and fits tightly into aperture 23.

FIG. 2 shows wire 42 positioned in an assembled connector. After the wire is placed in the first member, the second member can be placed thereover, as shown, by simply pushing it down sides 22 until hooks 28 snap into notches 24. Another way is to place the hooks into the notches at one end and slide the two members together. In the former case, pin 40 can be first placed into aperture 23. In the latter case, the pin must be dropped through hole 38 and into aperture 23 after the two members are in place.

Screw 36 has been turned down, compressing wire 42 against surface 20 in the view shown in FIG. 3. The generally oval shape of surface 20 causes the strands of wire 42 to shift about as the wire is being compressed to a greater degree than if the surface was arcuate. Accordingly, more scrubbing takes place between the strands and a better electrical connection is obtained. Further, as the screw compressed the wire, sidewalls 26, being resilient, are deformed towards a straight up and down configuration. The deformation must not exceed the material's elastic limit, however. In resiliently deforming the sidewalls, energy is stored therein so that should wire 42 creep as happens with aluminum wire, or the wire otherwise experiences a reduction in cross-sectional area, the sidewalls will move back towards their original concavo-convex shape and thereby take up the slack so that a continued pressure is maintained against the wire.

The function of pin 40 will be explained in conjunction with FIG. 7.

Base 16 may include an apertured projection as shown in FIG. 1. Electrical connector 10 thus may be secured to a post or other electrical device. Other connecting means may be provided to first member 18 if desired. Further, base 16 can be omitted and the connector used as a multi-wire splice, a tap-off and so forth.

Second member 14 is made from aluminum 6063-T6 or steel which provides the resiliency required of sidewalls 26.

FIGS. 4 through 7 illustrate another embodiment of the present invention. Electrical connector 44 is a one piece connector. Non-linear sidewalls 46 have a wavy or a generally S-shape. The distance therebetween increases upwardly from wire-receiving surface 48 to top wall 50 which extends between and joins the sidewalls at their upper edges. Threaded bore 52 in top wall 50 receives screw 36 (FIG. 5) and hole 54 freely receives pin 40 which is tightly received in aperture 56 (FIG. 7) in surface 48.

The connector may include base 16 and a connecting device.

Preferably electrical connector 44 is made from aluminum 6063-T6.

FIG. 5 is an end view of electrical connector 44 showing the shape of sidewalls 46. This view is to be compared with the view of FIG. 6 which is one taken after wire 42 has been placed on wire-receiving surface 48 thereagainst and compressed by screw 36. As the wire is being pushed down, sidewalls 46 are resiliently deformed towards a more linear configuration so that the connector increases in height; i.e., the distance between top wall 50 and surface 48 increases.

Provided the elastic limit of the material is not exceeded, the energy to deform the sidewalls becomes available to return the connector towards its original, shorter height. Accordingly, should the cross-sectional area of wire 42 become reduced for some reason, the pressure exerted by the screw is maintained.

The cross-sectional view of FIG. 7 demonstrates the function of pin 40. Note that the pin is sticking up above top wall 50 in FIG. 4 before wire 42 was clamped therein. The pin's first function is to provide a wire stop; i.e., the pin stops the wire when it has been inserted into the connector the proper distance. The second and more significant use of the pin is that it provides an indicator that screw 36 has been turned down far enough. As the sidewalls straighten up under the influence of the screw being turned down, as described above, the distance between the wire-receiving surface and the top wall, increases. With pin 40 being stationary, sufficient pressure has been applied when the upper surface of the top wall becomes flush with the top of the pin. A third function of pin 40 is to keep second member 14 from sliding off first member 18 before screw 36 is turned down against wire 42.

The lower end of screw 36 is semi-rounded in FIGS. 1–3 and flat across in FIGS. 4–7. FIG. 8 shows a screw-anvil combination. The lower end 60 of screw 62 carries stud 64. The stud is received in hole 66 in anvil 68. The lower surface 70 of the anvil is concave to rest conformably on wire 42. With stud 64 protruding below the top wall (in either embodiment) the anvil is secured thereto in any known manner.

I claim:

1. An electrical connector comprising:

a. a channel-shaped first member with the floors and sidewalls defining a wire-receiving surface and further having an upwardly extending pin fixed at one end of the wire-receiving surface;

b. a second member having resiliently deformable, non-linear sidewalls and a top wall extruding between and joining the sidewalls at their upper edges, said second member being positioned over the first member with the lower edges of the non-linear sidewalls being attached to the sides of the first member with the wire-receiving surface therebetween and with the pin extending through the top wall for a predetermined distance; and c. biasing means threadedly positioned in the top wall in alignment with the wire-receiving surface on the first member, said means adapted for being turned down against a wire which may be lying on the wire-receiving surface and in so doing, resiliently deforming the sidewalls towards a more linear shape with the energy stored in the resiliently deformed sidewalls available to maintain pressure on the wire, and further as the top wall moves away from the wire-receiving surface, the top of the pin and upper surface of the top wall become closer together to indicate the degree of compressive force being exerted against the wire.

* * * * *